US005785192A

United States Patent [19]

Dunham et al.

[11] Patent Number: 5,785,192

[45] Date of Patent: Jul. 28, 1998

[54] MODEL RAILROAD COUPLER

[75] Inventors: Michael Nathan Dunham; Lawrence D. Edwards, both of Eagle Point, Oreg.

[73] Assignee: Kadee Quality Products, Inc., White City, Oreg.

[21] Appl. No.: 808,519

[22] Filed: Feb. 28, 1997

[51] Int. Cl.[6] ..... B61G 7/00

[52] U.S. Cl. ..... 213/75 TC

[58] Field of Search ..... 213/75 R, 75 TC, 213/100 R, 104, 109

[56] References Cited

U.S. PATENT DOCUMENTS

| | | | |
|---|---|---|---|
| D. 326,693 | 6/1992 | Gramera . | |
| 629,497 | 7/1899 | Ewart . | |
| 2,162,390 | 6/1939 | Rydin . | |
| 2,409,920 | 10/1946 | Wicher . | |
| 2,574,630 | 11/1951 | Edwards et al. | 213/75 TC |
| 2,617,541 | 11/1952 | Godde . | |
| 2,631,740 | 3/1953 | Watson . | |
| 2,658,629 | 11/1953 | Pettit | 213/75 TC |
| 2,738,079 | 3/1956 | Ferris | 213/75 TC |
| 3,111,229 | 11/1963 | Edwards et al. . | |
| 3,115,255 | 12/1963 | Edwards et al. . | |
| 3,117,676 | 1/1964 | Edwards et al. . | |
| 3,469,713 | 9/1969 | Edwards et al. . | |
| 3,564,766 | 2/1971 | Edwards et al. . | |
| 3,942,648 | 3/1976 | Edwards et al. . | |
| 4,335,820 | 6/1982 | Gramera . | |
| 5,316,158 | 5/1994 | Dunham et al. | 213/75 TC |
| 5,509,546 | 4/1996 | Staat . | |

*Primary Examiner*—Mark T. Le
*Attorney, Agent, or Firm*—Robert D. Varitz

[57] ABSTRACT

An improved model railroad coupler incorporates a coupler shank, having a joining element at one end thereof and a coupler head at the other end thereof. A coupler-knuckle receiver is located within the coupler head and receives a coupler knuckle. The knuckle is provided with limited, rotational movement within the coupler head, through a predefined arc. The coupler head has a first knuckle stop located thereon which limits rotational movement of the coupler knuckle relative to the coupler head in a first direction of rotation. A second knuckle stop is located on one side of the coupler head adjacent to the shank. A knuckle limiter is located on the coupler knuckle. The second knuckle stop and the knuckle limiter are constructed and arranged to abut one another when the coupler knuckle is shifted to an open position, thereby stopping rotation of the coupler knuckle relative to the coupler head. A spring is carried on the second knuckle stop and the knuckle limiter, extends therebetween, and is operable to urge the coupler knuckle to a closed position wherein the coupler knuckle abuts the first knuckle stop.

13 Claims, 2 Drawing Sheets

MODEL RAILROAD COUPLER

FIELD OF THE INVENTION

This invention relates to couplers for model railroads, and specifically to an improved magnetically-actuated coupler head.

BACKGROUND OF THE INVENTION

It is a goal of model railroaders to build and run model railroad rolling stock which is as close to that used in prototype railway rolling stock as is possible. To this end, a great deal of effort is expended in order to duplicate, in scale, all of the features of prototypical rolling stock. In the case of couplers for prototypical rolling stock, as are used in the western hemisphere, couplers are made with a coupler head, attached to a shank, which is in turn connected to the rolling stock by means of a draft box. Attached to the coupler head is a knuckle which engages a like knuckle on another unit of rolling stock. Such structures are present on both prototypical railway and some model railroad couplers, however, the couplers that have been in use on model railroads deviate to a greater or lesser degree, depending on manufacturer, from the prototypical in order to accommodate the much smaller scale of the coupler components.

Another desirable feature of a model railroad coupler is the ability to remotely uncouple units of rolling stock from one another without physically handling the units of rolling stock. This has been achieved by the provision of a simulated air hose, which is made from a magnetically-active metal, and which may be caused to swing, shifting the coupler knuckle into an open position, when the simulated air hose is positioned over a magnetic ramp, whether such ramp be a permanent magnet or an electromagnet. A number of such magnetically actuated model railroad uncouplers are disclosed in patents to Edwards et al., such as U.S. Pat. Nos. 3,111,229, 3,115,255, 3,117,676, 3,469,713, 3,564,766, and 3,942,648. Variations on the magnetic couplers of Edwards et al. are depicted in U.S. Pat. No. 4,335,820 to Gramera, U.S. Pat. No. D326,693, also to Gramera, and U.S. Pat. No. 5,509,546 to Staat.

What is significant about all of the foregoing references is that, while they are generally operable to allow for remote, magnetic uncoupling of model railroad rolling stock, they are not prototypical, because additional structure has been incorporated into the coupler head and/or knuckle to make the scale version functional, thus departing from the prototypical appearance. Particularly in the case of some of the aforementioned Edwards et al. references, and the Staat reference, additional, non-prototypical structures are located on the side of the coupler head, which structures act as a stop to prevent the coupler knuckle from swinging beyond a predetermined arc. Such stops are not found on prototypical couplers. Additionally, known couplers are generally larger than "true scale" size. For instance, HO scale is a 1/85 scale. A typical HO coupler is approximately 1/70 scale. Efforts have been made to make the couplers smaller, approaching 1/85 scale, however the presence of extra, extraneous structure has made this task difficult.

SUMMARY OF THE INVENTION

The improved coupler of the invention incorporates the usual coupler shank, having a joining element at one end thereof and a coupler head at the other end thereof. A coupler-knuckle receiver is located within the coupler head and receives a coupler knuckle. The knuckle is provided with limited, rotational movement within the coupler head, through a predefined arc. The coupler head has a first knuckle stop located thereon which limits rotational movement of the coupler knuckle relative to the coupler head in a first direction of rotation, wherein the knuckle is in a closed position. A second knuckle stop is located on one side of the coupler head adjacent to the shank. A knuckle limiter is located on the coupler knuckle. The second knuckle stop and the knuckle limiter are constructed and arranged to abut one another when the coupler knuckle is shifted to an open position, thereby stopping rotation of the coupler knuckle relative to the coupler head in a second direction. A spring extends between the second knuckle stop and the knuckle limiter and is operable to urge the coupler knuckle to a closed position wherein the coupler knuckle abuts the first knuckle stop.

It is an object of the invention to provide a model railroad coupler which closely resembles prototypical couplers.

Another object of the invention is to provide a model railroader with a coupler which is magnetically actuated and which allows for remote uncoupling of units of model railroad rolling stock.

These and other objects and advantages of the invention will become more fully apparent as the description which follows is read in connection with the drawings.

BRIEF DESCRIPTION OF THE PREFERRED EMBODIMENTS

Figure 1:
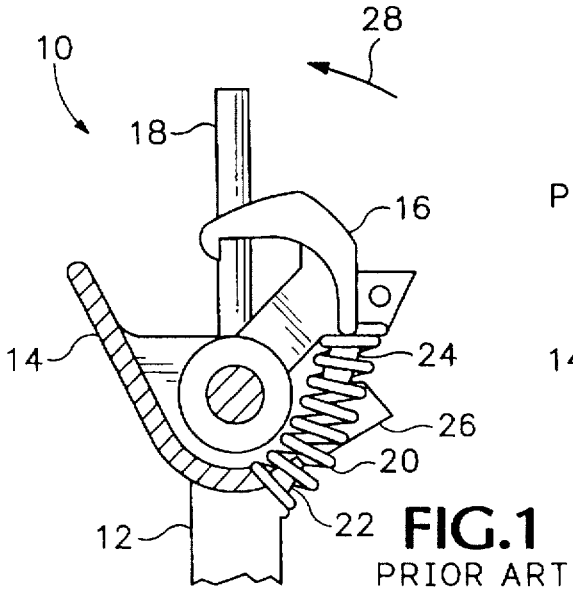
FIG.1 PRIOR ART
FIG. 1 depicts a prior art coupler with a coupler knuckle thereof in a closed position.
Figure 2:
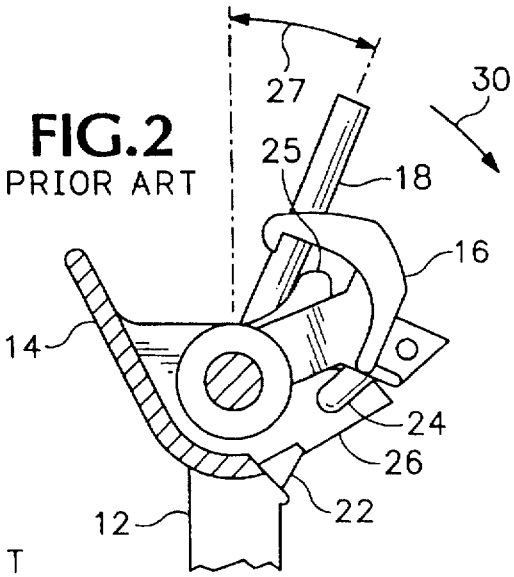
FIG.2 PRIOR ART
FIG. 2 depicts a prior art coupler with the coupler knuckle thereof in an open position.
Figure 3:
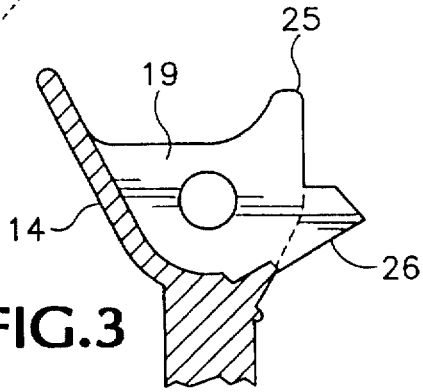
FIG. 3 is a median section through the coupler head of the coupler of FIGS. 1 and 2 depicting a non-prototypical structure thereon.

Turning now to the drawings, and initially to FIGS. 1 and 2, a prior art coupler for model railroad rolling stock is depicted generally at 10. FIG. 3 depicts a coupler head and shank as used in prior art couplers, and is also used to depict a feature of the instant invention. Coupler 10 includes a shank 12, a coupler head 14, and a coupler knuckle 16. A simulated air hose is depicted at 18, and serves to rotatably fix knuckle 16 within a knuckle receiver 19 (FIG. 3), located in coupler head 14, to allow pivotal motion of knuckle 16 relative to coupler head 14, and also to serve as an actuator under the influence of a magnetic field. A knuckle spring 20 extends between a spring boss 22, located on shank 12 and a knuckle boss 24, located on knuckle 16.

A knuckle stop 26 extends laterally from coupler head 14 and serves to confine knuckle 16 within a predetermined arc of rotation 27 (FIG. 2), initially preventing rotation of knuckle 16 beyond a predetermined limit of rotation in a first direction, as indicated by arrow 28. Referring to FIG. 2, it is seen that when knuckle 16 is shifted to its full limit of travel in a second direction 30, spring bosses 22, 24 do not contact one another, and that knuckle 16 abuts knuckle stop 26.

As previously noted, it is an object of the invention to provide a coupler structure which closely resembles prototypical couplers. To this end, it is desirable to eliminate second knuckle stop 26, thereby reducing the actual size of the coupler, and enabling the coupler to be constructed more closely to a true scale size. Removal of second knuckle stop 26 will give the improved coupler head a configuration as shown in FIGS. 4–10, and as shown in FIG. 3, once the hatched area of knuckle stop 26 is removed. It is, however, still necessary to provide a mechanism for limiting the movement of the coupler knuckle so some form of knuckle travel-limiter must still be provided. Existing spring bosses are not constructed with sufficient length to limit knuckle movement, and are not constructed to provide suitable abutting surfaces. Even if the spring bosses of known model railroad couplers were lengthened, they would not abut properly to limit knuckle movement to an operable position. As shown in FIG. 2, if knuckle 16 opened beyond arc 27, knuckle spring boss 24 would rotate inside of shank spring boss 22, and would not be operable to limit angular movement of knuckle 16. Movement beyond arc 27 may also result in the deformation of spring 20.

Figure 4:
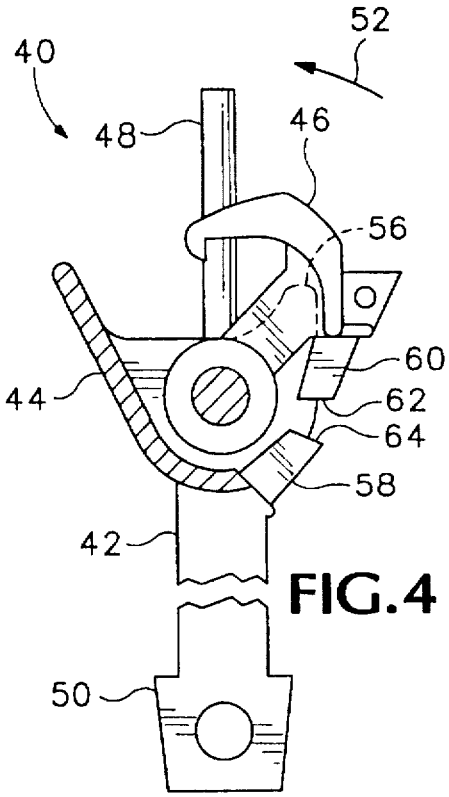
FIG. 4 depicts a first embodiment of an improved coupler of the invention, with the coupler knuckle in a closed position.
Figure 5:
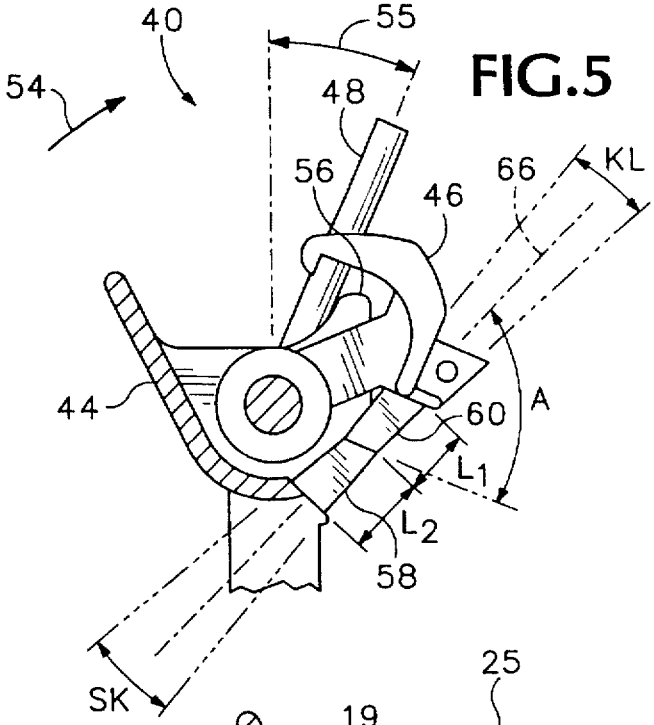
FIG. 5 depicts the improved coupler of FIG. 4, with the knuckle in an open position.

Referring now to FIGS. 4 and 5, a first embodiment of an improved coupler constructed according to the invention is depicted generally at 40. Improved coupler 40 includes a shank 42, an improved coupler head 44, a modified coupler knuckle 46, and a simulated air hose 48. Coupler knuckle 46 is received in a knuckle receiver of coupler head 44, which receiver is constructed similarly to that of knuckle receiver 19, shown in FIG. 3. A joining element 50 is located at the other end of shank 42 and is operable to join improved coupler 40 to a unit of model railroad rolling stock.

As depicted in FIG. 4, knuckle 46 is shown in a closed position, which is a result of rotation of knuckle 46 relative to head 44 in a first direction of rotation, indicated by arrow 52. In FIG. 5, knuckle 46 is depicted in an open position, which is the result of movement of knuckle 46 relative to coupler head 44 in a second direction of rotation, indicated by arrow 54, having traveled through a predefined arc 55. As depicted in FIG. 4, knuckle 46 is shown in abutment with a first knuckle stop 56, located on coupler head 44.

To prevent movement of coupler knuckle 46 beyond predefined arc 55 in the second direction, a second knuckle stop 58 is located on one side of coupler head 44 adjacent shank 42. A knuckle limiter 60 is located on the coupler knuckle. Second knuckle stop 58 and knuckle limiter 60 also serve as spring bosses to receive a spring 82 (shown in FIG. 10), which urges knuckle 46 to its closed position in first direction 52. Second knuckle stop 58 and knuckle limiter 60 are constructed and arranged to abut one another and include, on knuckle limiter 60, a first abutting surface 62, and on second knuckle stop 58, a second abutting surface 64, which abutting surfaces are arranged to contact each other, thereby stopping rotation of the coupler knuckle relative to the coupler head in the second direction of rotation.

An axis, represented by dash-dot line 66, extends through knuckle limiter 60 and second knuckle stop 58, with knuckle 46 in its open position. Both of these structures have frusto-conical shapes and, in the first embodiment described herein, have substantially equal lengths, $L_1$ and $L_2$, respectively. In this embodiment of the invention, the first and second abutting surfaces have an angle "A" of between about 65° and 105° relative to the axis 66, with the preferred angle being about 85°. The flat abutting surface configuration is preferred, however, a point contact, as provided in the third embodiment disclosed herein, may also be used.

As previously noted, both knuckle limiter 60 and second knuckle stop 58 have frusto-conical configurations and, in the embodiments described herein, knuckle limiter 60 has a conical angle "KL" of between about 10° and 30°. Second knuckle stop 58 has a conical angle "SK" of between about 10° and 50°. The preferred value for KL is about 15° and that for SK is about 22°.

An advantage of using knuckle limiter 60 and second knuckle stop 58 as spring bosses is that, because of the extended length of limiter 60 and stop 58 over prior art spring bosses, the springs used to urge knuckle 46 to its closed position are less likely to pop off of the bosses, although such spontaneous spring removal is a relatively rare occurrence. Knuckle limiter 60 and second knuckle stop 58 are longer than the spring bosses used in prior art couplers, such as 22, 24, and therefore provide more surface area to frictionally grip the knuckle spring. The greater length requires that a knuckle spring be virtually totally compressed before the spring may escape over the free end of either the knuckle limiter or the second knuckle stop. Installation of a knuckle spring is most easily accomplished by placing the spring on the longer of the knuckle limiter or second knuckle stop.

Figure 6:
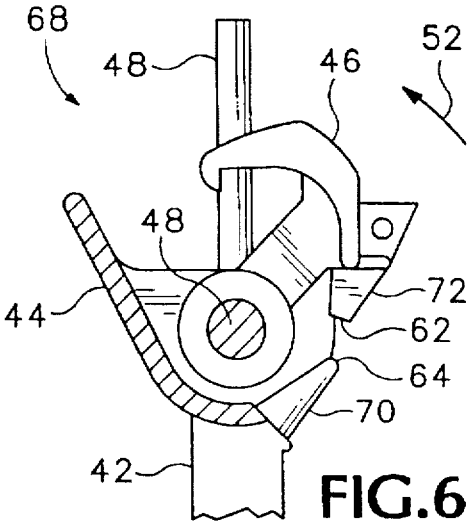
FIGS. 6 and 7 depict a second embodiment of the improved coupler of the invention.
Figure 7:
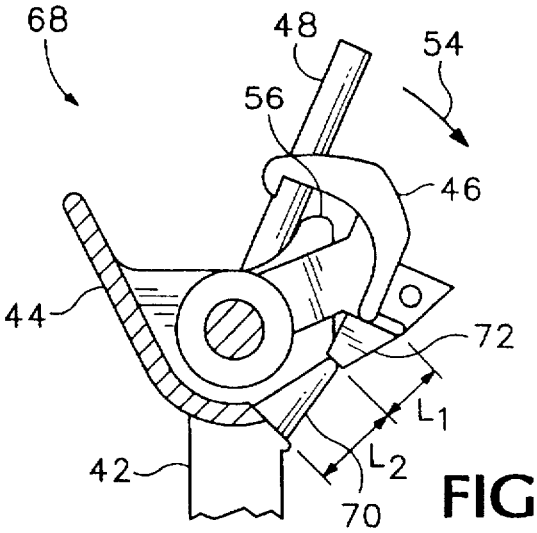

Referring now to FIGS. 6 and 7, a second embodiment of the invention is depicted at 68, wherein a second knuckle stop 70 is longer than a knuckle limiter 72, i.e., $L_2>L_1$. Angle A in this embodiment has a value of between about 40° to 80°, with a preferred angle of about 60°.

Figure 8:
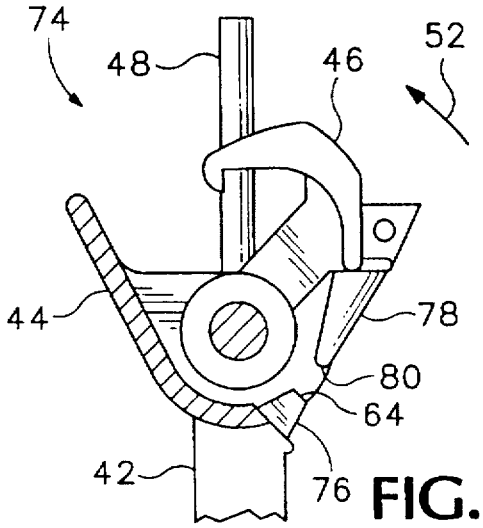
FIGS. 8 and 9 depict a third embodiment of the improved coupler of the invention.
Figure 9:
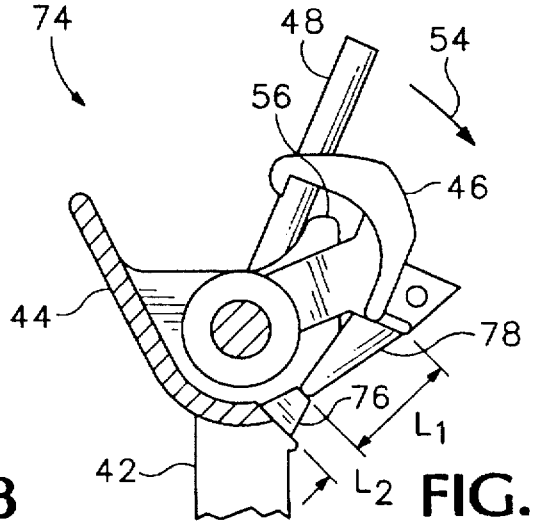

Referring now to FIGS. 8 and 9, a third embodiment of the invention is depicted at 74, wherein a second knuckle stop 76 is shorter than a knuckle limiter 78, i.e., $L_2<L_1$. Angle A in this embodiment again has a value of between about 40° to 80°, with a preferred angle of about 60°, however, first abutting surface 80 on knuckle limiter 78 terminates in a radius that impinges on a substantially flat second abutting surface 64 on second knuckle stop 76.

Figure 10:
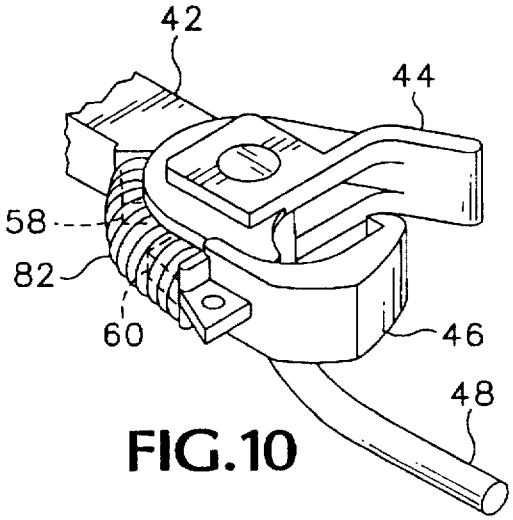
FIG. 10 is a perspective view of the improved coupler of the invention.

Referring now to FIG. 10, the improved coupler is depicted in perspective which shows a coupler spring 82 extending between second knuckle stop and a knuckle limited, which is depicted as having shifted knuckle 46 to its closed position.

Thus, an improved coupler for use with model railroad rolling stock has been disclosed which is substantially closer in appearance to prototypical railway couplers than previously used model railroad couplers. Although a preferred embodiment of the invention and variations thereof has been disclosed herein, it should be appreciated that further modifications and variations may be made thereto without departing from the scope of the invention as defined in the appended claims.

I claim:

1. An improved coupler for use on a model railroad, the coupler including a shank, having a joining element at one end thereof for attaching the coupler to a unit of model railroad rolling stock, a coupler head, located at the other end of the shank, the coupler head having a coupler knuckle receiver for receiving a coupler knuckle therein for limited, rotational movement within the coupler head, the coupler knuckle being located on one side of the coupler head, the coupler head further having a first knuckle stop thereon for limiting rotational movement of the coupler knuckle relative to the coupler head in a first direction of rotation, and a spring extending between the coupler knuckle and the coupler head for urging the coupler knuckle, in the first direction of rotation, to a closed position, the improvement comprising:

a second knuckle stop located on the one side of the coupler head adjacent the shank, for receiving one end of the spring thereon; and a knuckle limiter located on the coupler knuckle for receiving the other end of the spring thereon;

wherein said second knuckle stop and said knuckle limiter are constructed and arranged to abut one another when the coupler knuckle is shifted, in a second direction of rotation, to an open position, thereby stopping rotation of the coupler knuckle relative to the coupler head in the second direction of rotation.

2. The improved coupler of claim 1 wherein said second knuckle stop and said knuckle limiter are of substantially equal length.

3. The improved coupler of claim 1 wherein said second knuckle stop is longer than said knuckle limiter.

4. The improved coupler of claim 1 wherein said second knuckle stop is shorter than said knuckle limiter.

5. The improved coupler of claim 1 wherein said second knuckle stop and said knuckle limiter have a substantially frusto-conical shape.

6. An improved coupler for use on a model railroad, the coupler including a shank, having a joining element at one end thereof for attaching the coupler to a unit of model railroad rolling stock, a coupler head, located at the other end of the shank, the coupler head having a coupler knuckle receiver for receiving a coupler knuckle therein for limited, rotational movement within the coupler head, the coupler knuckle being located on one side of the coupler head, the coupler head further having a first knuckle stop thereon for limiting rotational movement of the coupler knuckle relative to the coupler head in a first direction of rotation, and a spring extending between the coupler knuckle and the coupler head for urging the coupler knuckle, in the first direction of rotation, to a closed position, the improvement comprising:

a knuckle limiter located on the coupler knuckle for receiving the other end of the spring thereon, and having a first abutting surface thereon;

a second knuckle stop located on the one side of the coupler head adjacent the shank, for receiving one end of the spring thereon, and having a second abutting surface thereon; and wherein said second knuckle stop and said knuckle limiter have a substantially frusto-conical shape.

wherein said knuckle limiter and said second knuckle stop are constructed and arranged to abut one another with said first and second abutting surfaces, respectively, when the coupler knuckle is shifted, in a second direction of rotation, to an open position, thereby stopping rotation of the coupler knuckle relative to the coupler head in the second direction of rotation.

7. The improved coupler of claim 6 wherein said second knuckle stop and said knuckle limiter are of substantially equal length.

8. The improved coupler of claim 6 wherein said second knuckle stop is longer than said knuckle limiter.

9. The improved coupler of claim 6 wherein said second knuckle stop is shorter than said knuckle limiter.

10. The improved coupler of claim 6 wherein said first and second abutting surfaces have an angle "A" of between about 65° and 105° relative to the axis of said knuckle limiter and said second knuckle stop, respectively.

11. The improved coupler of claim 6 wherein said first and second abutting surfaces have an angle "A" of between about 40° and 80° relative to the axis of said knuckle limiter and said second knuckle stop, respectively.

12. The improved coupler of claim 6 wherein said first and second abutting surfaces have an angle "A" of between about 60° and 80° relative to the axis of said knuckle limiter and said second knuckle stop, respectively, and wherein one of said abutting surfaces is formed as a radius and the other abutting surface is substantially flat.

13. The improved coupler of claim 6 wherein said knuckle limiter has a conical angle "KL" of between about 10° and 30°, and wherein said second knuckle stop has a conical angle "SK" of between about 10° and 50°.

* * * * *